US011352913B2

(12) United States Patent
Lu et al.

(10) Patent No.: US 11,352,913 B2
(45) Date of Patent: Jun. 7, 2022

(54) VARIABLE VALVE LIFT DEVICE AND AUTOMOBILE

(71) Applicant: Guangzhou Automobile Group Co., Ltd., Guangdong (CN)

(72) Inventors: Zhen Lu, Guangdong (CN); Hainian Lian, Guangdong (CN); Liang Chen, Guangdong (CN); Qizhou Zhang, Guangdong (CN)

(73) Assignee: GUANGZHOU AUTOMOBILE GROUP CO., LTD., Guangzhou (CN)

( * ) Notice: Subject to any disclaimer, the term of this patent is extended or adjusted under 35 U.S.C. 154(b) by 24 days.

(21) Appl. No.: 16/334,028

(22) PCT Filed: Oct. 30, 2018

(86) PCT No.: PCT/CN2018/112593

§ 371 (c)(1),
(2) Date: Mar. 18, 2019

(87) PCT Pub. No.: WO2019/119979

PCT Pub. Date: Jun. 27, 2019

(65) Prior Publication Data

US 2021/0332725 A1 Oct. 28, 2021

(30) Foreign Application Priority Data

Dec. 20, 2017 (CN) ..... 201711384610.6
Dec. 20, 2017 (CN) ..... 201721819870.7

(51) Int. Cl.

| | |
|---|---|
| ***F01L 1/047*** | (2006.01) |
| ***F01L 1/46*** | (2006.01) |
| ***F01L 13/00*** | (2006.01) |

(52) U.S. Cl.
CPC ..... *F01L 1/047* (2013.01); *F01L 1/462* (2013.01); *F01L 13/0036* (2013.01); *F01L 2001/0473* (2013.01); *F01L 2013/0052* (2013.01)

(58) Field of Classification Search
CPC ..... F01L 13/0036; F01L 1/047; F01L 1/462; F01L 2013/0052; F01L 2001/0473
(Continued)

(56) References Cited

U.S. PATENT DOCUMENTS 5,704,317 A * 1/1998 Barth ..... F01L 1/34406 123/90.17
5,862,783 A * 1/1999 Lewis ..... F01L 1/34413 123/90.17
(Continued)

FOREIGN PATENT DOCUMENTS

CN 1382245 A 11/2002
CN 107076290 A 8/2017
(Continued)

OTHER PUBLICATIONS

DE-102007016977, Oct. 2008, english language machine translation.*

*Primary Examiner* — Devon C Kramer
*Assistant Examiner* — Wesley G Harris
(74) *Attorney, Agent, or Firm* — ScienBiziP, P.C.

(57) ABSTRACT

Some embodiments of a present disclosure provide a variable valve lift device. The variable valve lift device includes a main shaft, a sleeve, an oil cylinder and a valve mechanism. The sleeve is provided on the main shaft in a sleeve manner, can be driven by the main shaft to rotate together with the main shaft, and can further linearly move relative to the main shaft along an axis direction of the main shaft. A cam assembly is disposed on the sleeve, and includes at least two cams with different projection heights. The oil
(Continued)

cylinder includes a cylinder barrel and a piston disposed in the cylinder barrel, the cylinder barrel is fixed onto the main shaft, the piston is fixedly connected to the sleeve. Some embodiments of the present disclosure provide an automobile having the above variable valve lift device.

10 Claims, 6 Drawing Sheets

(58) Field of Classification Search
USPC ..... 123/90.17, 90.18
See application file for complete search history.

(56) References Cited

U.S. PATENT DOCUMENTS

| | | | | |
|---|---|---|---|---|
| 6,415,753 | B1 * | 7/2002 | Nagaosa | F01L 1/34 123/90.15 |
| 2005/0011480 | A1 * | 1/2005 | Schultz | F01L 13/0036 123/90.16 |

FOREIGN PATENT DOCUMENTS

| | | | | |
|---|---|---|---|---|
| CN | 108167043 | A | 6/2018 | |
| CN | 207813681 | U | 9/2018 | |
| DE | 3937628 | A1 * | 5/1991 | F01L 1/34403 |
| DE | 102007016977 | A1 * | 10/2008 | F01L 13/0036 |
| DE | 102007016977 | A1 | 10/2008 | |
| DE | 102009015453 | A1 | 9/2010 | |
| WO | 2017063941 | A1 | 4/2017 | |

* cited by examiner

VARIABLE VALVE LIFT DEVICE AND AUTOMOBILE

The present disclosure claims priority to China Patent Application No. 201711384610.6, filed on Dec. 20, 2017 and China Patent Application No. 201721819870.7, filed on Dec. 20, 2017, which are hereby incorporated by reference in its entirety.

TECHNICAL FIELD

The present disclosure relates to a technical field of vehicle engines, and more particularly to a variable valve lift device and an automobile having the variable valve lift device.

BACKGROUND

During operation, a reciprocating internal combustion engine can periodically open and close a valve through a valve driving mechanism, so that an engine can effectively inhale fresh air or combustible mixture gas and eliminate exhaust gas burning in a cylinder. After the design of a traditional valve driving mechanism, a valve movement law is solidified, and a duration of valve lift and valve opening cannot be adjusted according to an actual operation of the engine.

The engine of the vehicle is operated under full working conditions, and it is necessary to balance high-load dynamics and low-load economy in design. However, the fixed valve movement law makes the engine only in an optimal state under a certain working condition, and it is impossible to balance power and economy in most cases.

Technical Problem

In order to overcome such defects of the engine, variable valve lift, devices are increasingly being used in engines. The variable valve lift devices can be divided into sectional variable valve lift devices and continuously variable valve lift devices according to functions. According to the implementation, the variable valve lift devices can be divided into hydraulic switching, type variable valve lift devices and electronically controlled mechanical variable valve lift devices. The continuously variable valve lift device can change the lift and phase at will at the maximum valve lift and valve timing, and can perform lift conversion at a higher speed, but the continuously variable valve lift device requires a large arrangement space, and is high in cost and poor in reliability; the variable valve lift device controlled by the electronically controlled machine is low in reliability, complicated in structure arrangement and easy to wear, thereby causing the cam switching to be invalid; the hydraulic switching type sectional variable valve lift device has obvious advantages in reliability, but it also has the disadvantages of requiring a large arrangement space, complicated work position switching, complicated oil passage, and the like.

SUMMARY

Technical Solution

In view of this, some embodiments of the present disclosure provide a variable valve lift device and an automobile having the variable valve lift device. The variable valve lift devices in some embodiments have the advantages of simple structure, compact arrangement space, simplicity in control, easiness in switching a working position, and the like.

An embodiment of the present disclosure provides a variable valve lift device. The variable valve lift device includes a main shaft, a sleeve, an oil cylinder and a valve mechanism. The sleeve is provided on the main shaft in a sleeve manner, the sleeve can be driven by the main shaft to rotate together with the main shaft, and the sleeve can further linearly move relative to the main shaft along an axis direction of the main shaft. A cam assembly is provided on the sleeve, and the cam assembly includes at least two cams with different projection heights. The oil cylinder includes a cylinder barrel and a piston provided in the cylinder barrel, the cylinder barrel is fixed onto the main shaft, the piston is fixedly connected to the sleeve, and the oil cylinder is used for driving the sleeve to linearly move relative to the main shaft along the axis direction of the main shaft, and selectively enabling the cams with different projection heights to contact the valve mechanism.

In an exemplary embodiment, the at least two cams with different projection heights include a first cam and a second cam, the first cam and the second cam are provided adjacent to each other, and a projection height of the first cam is greater than a projection height of the second cam.

In an exemplary embodiment, the variable valve lift device further includes a return spring, wherein the return spring is sleeved on the main shaft, the oil cylinder and the return spring are respectively located at both ends of the sleeve, when hydraulic oil is fed into the oil cylinder, the sleeve is driven by the piston to linearly move toward one end of the main shaft along the axis direction of the main shaft and compresses the return spring, and when hydraulic oil in the oil cylinder flows out, the return spring drives the sleeve to linearly move toward the other end of the main shaft along the axis direction of the main shaft through an elastic force.

In an exemplary embodiment, the oil cylinder includes an oil inlet and an oil return port, the oil cylinder has an oil chamber, and both the oil inlet and the oil return port are communicated with the oil chamber; the variable valve lift device further includes a reversing valve; the reversing valve includes an oil port A and an oil port B on one side and an oil port C and an oil port D on the other side, the oil port C is connected to the oil inlet of the oil cylinder, and the oil port D is connected to the oil return port of the oil cylinder; the reversing valve includes a middle position, a first working position and a second working position; when the reversing valve is at the middle position, oil ports on both sides of the reversing valve do not communicate with each other; when the reversing valve is at the first working position, the oil port A communicates with the oil port C, and the oil port B does not communicate with the oil port D; and when the reversing valve is at the second working position, the oil port B communicates with the oil port D, and the oil port A does not communicate with the oil port C.

In an exemplary embodiment, the oil cylinder is further provided with a receiving cavity, a protruding portion is provided at an end, close to the oil cylinder, of the sleeve, the protruding portion protrudes into the receiving cavity, a buffer spring is disposed in the receiving cavity, one end of the buffer spring abuts against an end of the cylinder barrel, and the other end of the buffer spring abuts against an end surface of the protruding portion.

In an exemplary embodiment, a first oil chamber is formed between one end of the cylinder barrel and the piston, and a second oil chamber is formed between the other end of the cylinder barrel and the piston; when hydraulic oil is fed into the first oil chamber and hydraulic oil in the second oil chamber flows out, the oil cylinder drives, through the piston, the sleeve to linearly move toward one end of the main shaft along the axis direction of the main shaft; and when hydraulic oil is fed into the second oil chamber and hydraulic oil in the first oil chamber flows out, the oil cylinder drives, through the piston, the sleeve to linearly move toward the other end of the main shaft along the axis direction of the main shaft through an elastic force.

In an exemplary embodiment, the oil cylinder includes a first oil port and a second oil port, wherein the first oil port communicates with the first oil chamber, and the second oil port communicates with the second oil chamber; the variable valve lift device further includes a reversing valve; the reversing valve includes an oil port A and an oil port B on one side and an oil port C and an oil port D on the other side, the oil port C is connected to the first oil port of the oil cylinder, and the oil port D is connected to the second oil port of the oil cylinder; the reversing valve includes a middle position, a first working position and a second working position; when the reversing valve is at the middle position, oil ports on both sides of the reversing valve do not communicate with each other; when the reversing valve is at the first working position, the oil port A communicates with the oil port C, and the oil port B communicates with the oil port D; and when the reversing valve is at the second working position, the oil port A communicates with the oil port D, and the oil port B communicates with the oil port C.

In an exemplary embodiment, the variable valve lift device further includes a position detection device, wherein the position detection device is configured to detect a position of the sleeve.

In an exemplary embodiment, the variable valve lift device further includes a locking mechanism, wherein the locking mechanism includes a locking ball head and a locking spring, the locking ball head is fixed to an end of the locking spring, one of an inner side wall of the sleeve and the main shaft is provided with a receiving groove, the locking spring is fixed in the receiving groove, the other one of the inner side wall of the sleeve and the main shaft is provided with locking grooves, a number and spacing of the locking grooves correspond to a number and spacing of the at least two cams in the cam assembly, and when any one of the at least two cams in the cam assembly is in contact with the valve mechanism, the locking ball head extends into a locking groove in the locking grooves corresponding to a cam in the at least two cams.

In an exemplary embodiment, the receiving groove is provided on the main shaft, and the locking groove is provided on the inner side wall of the sleeve.

In an exemplary embodiment, the main shaft is provided with a spline extending along the axis direction of the main shaft, an inner side wall of the sleeve is provided with a spline groove fitting the spline, and when the sleeve is provided on the main shaft in a sleeve manner, the spline extends into the spline groove.

An embodiment of the present disclosure also provides an automobile, including the above variable valve lift device.

Beneficial Effect

In the embodiment of the present disclosure, the sleeve can move along the axis direction of the main shaft, and can also rotate together with the main shaft under a driving of the main shaft. By means of the oil cylinder, the position of the sleeve and the valve mechanism can be adjusted under the driving of the oil cylinder, and the cams with different projection heights are selectively enabled to contact a roller rocker arm to change the valve lift and the valve timing. The oil cylinder controls the sleeve to linearly move on the main shaft, and the working position of the variable valve lift device is switched without adding any other intermediate transition structure. Therefore, the variable valve lift device has the advantages of simple structure, compact arrangement space, simplicity in control, easiness in switching a working position, and the like.

DETAILED DESCRIPTION OF THE EMBODIMENTS

To further explain the technical means and effects of the present disclosure for achieving the intended purpose of the disclosure, the present disclosure will be described in detail below with reference to the accompanying drawings and preferred embodiments.

Some embodiments of the present disclosure provide a variable valve lift device and an automobile having the variable valve lift device. The variable valve lift device in an embodiment, has the advantages of simple structure, compact arrangement space, simplicity in control, easiness in switching a working position, and the like.

Figure 1:
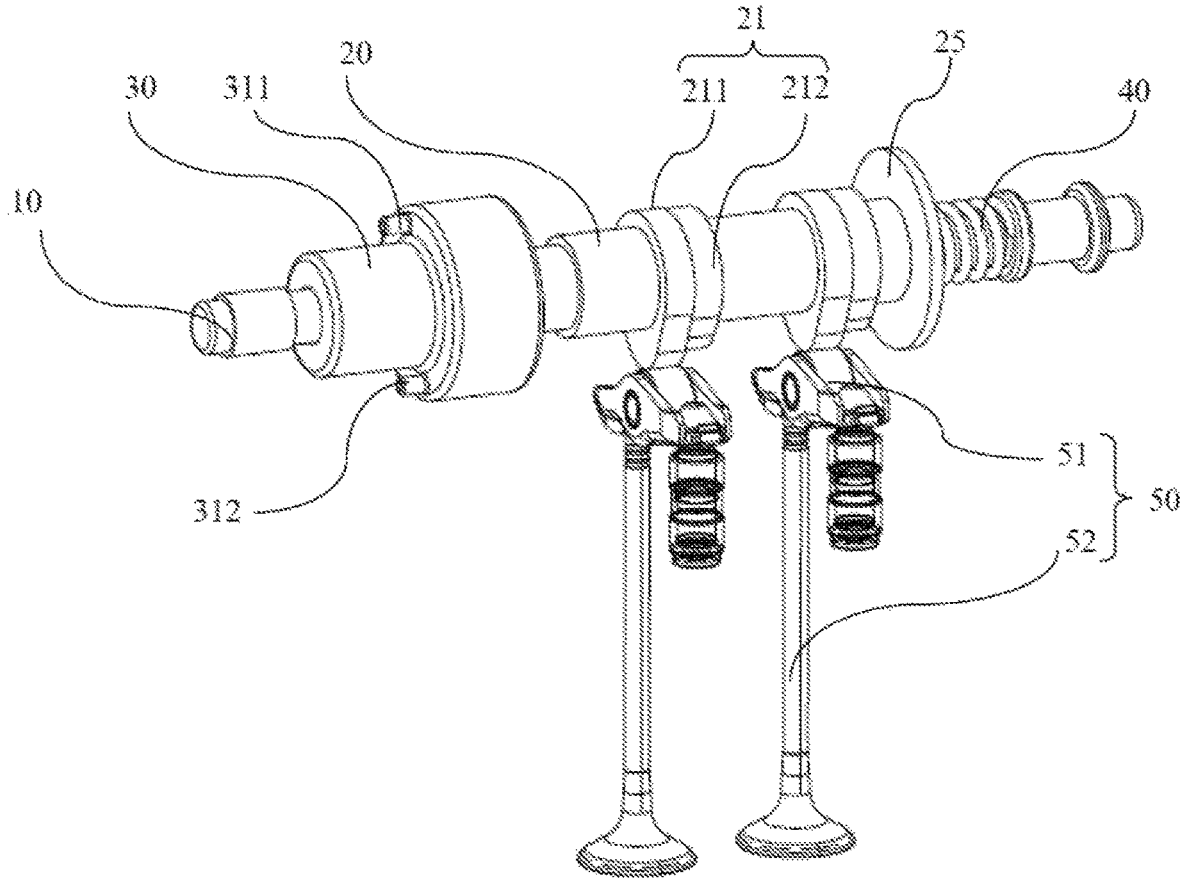
FIG. 1 is a structural schematic diagram of a variable valve lift device according to a first embodiment of the present disclosure.
Figure 2:
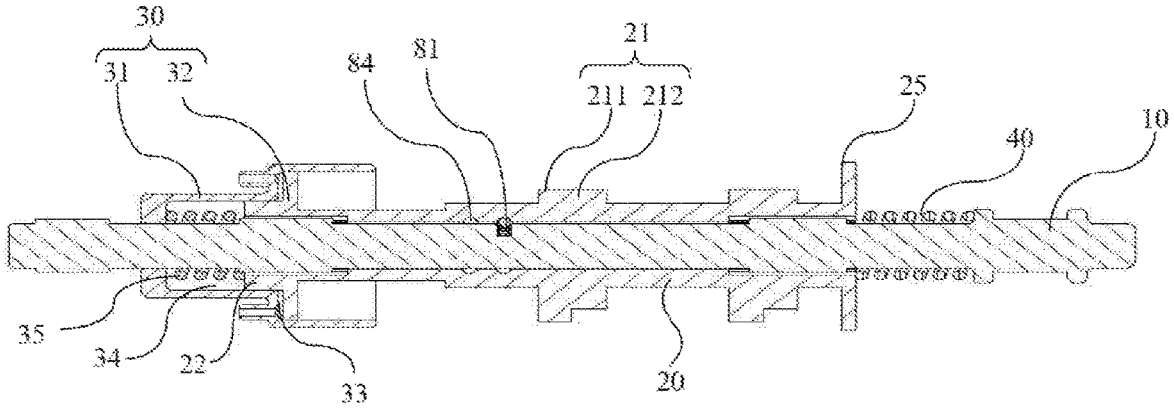
FIG. 2 is a cross-sectional schematic diagram of FIG. 1 after a valve mechanism is removed.

FIG. 1 is a structural schematic diagram of a variable valve lift device according to a first embodiment of the present disclosure. FIG. 2 is a cross-sectional schematic diagram of FIG. 1 after a valve mechanism is removed. As shown in FIG. 1 and FIG. 2, in an embodiment, the variable valve lift device includes a main shaft 10, a sleeve 20, an, oil cylinder 30 and a valve mechanism 50. The sleeve 20 is provided on the main shaft 10 in a sleeve manner, and the sleeve 20 can be driven by the main shaft 10 to rotate together with the main shaft 10, and can linearly move relative to the main shaft 10 along an axis direction of the main shaft 10. A cam assembly 21 is provided on the sleeve 20, and the cam assembly 21 includes at least two cams with different projection heights such as a first cam 211 and a second cam 212, where the first cam 211 and the second cam 212 are provided adjacent to each other. In an exemplary embodiment, a projection height of the first cam 211 is greater than a projection height of the second cam 212, that is, the projection height of the first cam 211 is greater, and the projection height of the second cam 212 is smaller.

The oil cylinder 30 includes a cylinder barrel 31 and a piston 32 provided in the cylinder barrel 31, the cylinder barrel 31 is fixed onto the main shaft 10, the piston 32 is fixedly connected to the sleeve 20, and the oil cylinder 30 is configured to drive the sleeve 20 to linearly move relative to the main shaft 10 along the axis direction of the main shaft 10, such that different cams 211, 212 of the cam assembly 21 contact the valve mechanism 50.

The valve mechanism 50 includes a roller rocker arm 51 and a valve 52 connected to the roller rocker arm 51. The cam assembly 21 is in contact with the roller rocker arm 51 so as to drive the roller rocker arm 51 to reciprocating motion.

Figure 3:
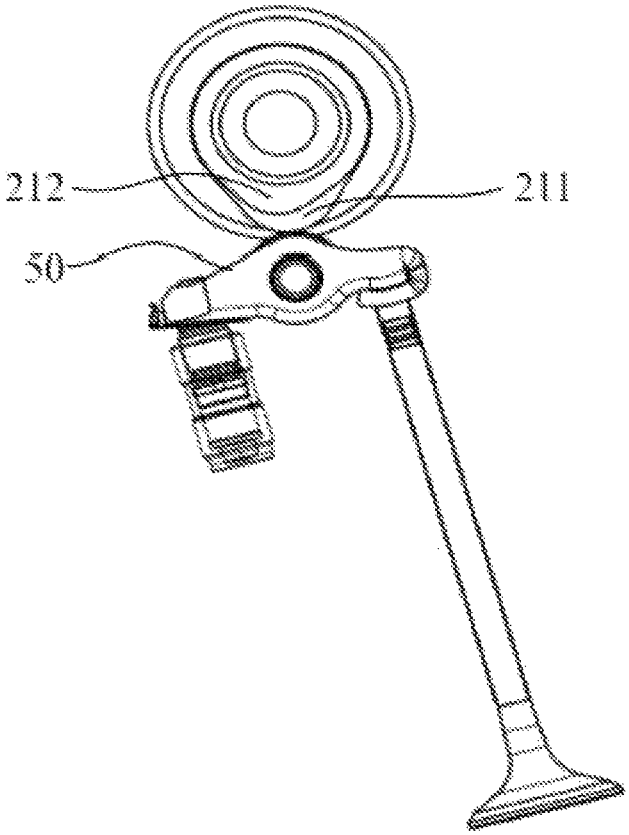
FIG. 3 is a structural schematic diagram of the variable valve lift device in FIG. 1 during large lift operation.
Figure 4:
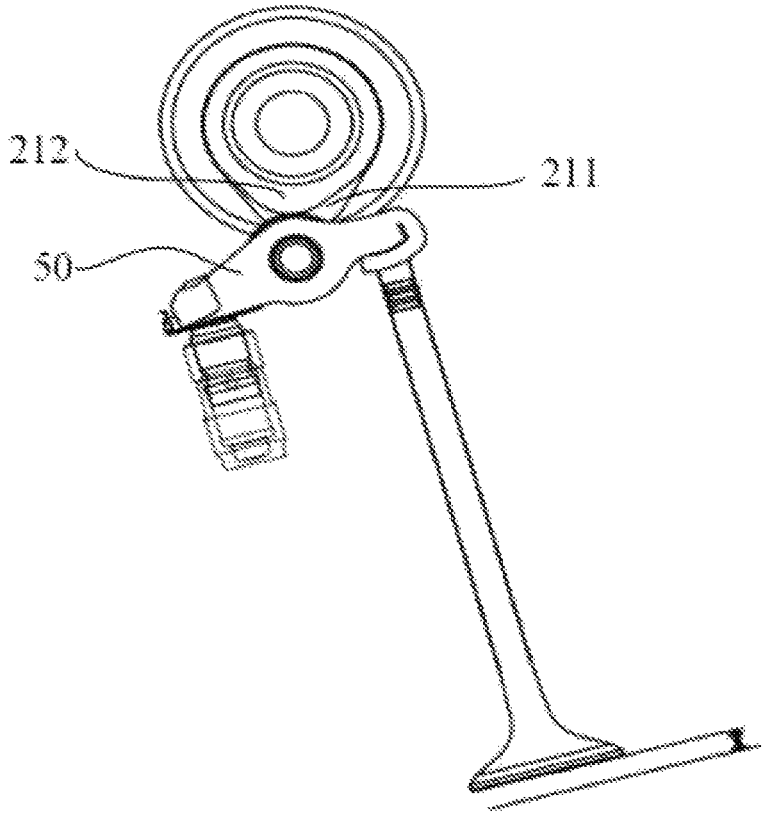
FIG. 4 is a structural schematic diagram of the variable valve lift device in FIG. 1 during small lift operation.

FIG. 3 is a structural schematic diagram of a variable valve lift device during large lift operation. FIG. 4 is a structural schematic diagram of a variable valve lift device during small lift operation. As shown in FIG. 3 and FIG. 4, under the driving of the oil cylinder 30, the sleeve 20 will linearly move relative to the main shaft 10 along the axis direction of the main shaft 10, thereby selectively enabling the first cam 211 or the second cam 212 to contact the valve mechanism 50. As shown in FIG. 3, when the first cam 211 with a greater projection height is in contact with the valve mechanism 50, the valve lift is greater. As shown in FIG. 4, when the second cam 212 with a smaller projection height is in contact with the valve mechanism 50, the valve lift is smaller.

Figure 5:
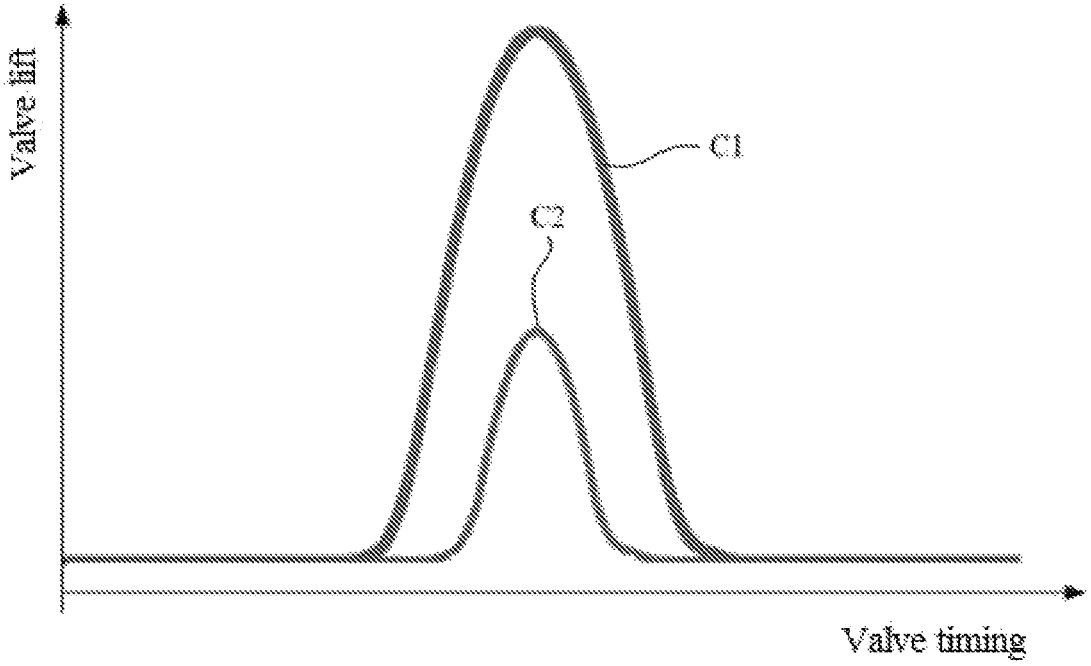
FIG. 5 is a schematic diagram showing a relation curve between the valve lift and the valve timing of the variable valve lift device in FIG. 1.

FIG. 5 is a schematic diagram showing a relation curve between the valve lift and the valve timing of the variable valve lift device in FIG. 1. The x coordinate is valve timing, and the y coordinate is valve lift. The curve C1 in the figure indicates a relation curve between the valve lift and the valve timing when the first cam 211 with a larger projection height is in contact with the valve mechanism 50, and the curve C2 in the figure indicates a relation curve between the valve lift and the valve timing when the second cam 212 with a smaller projection height is in contact with the valve mechanism 50. As can be seen from FIG. 5, when the first cam 211 and the second cam 212 with different projection heights are respectively in contact with the valve mechanism 50, both the valve lift and the valve timing are changed.

That is, by means of the oil cylinder 30, the sleeve 20 can be driven by the oil cylinder 30 to linearly move relative to the main shaft 10 along the axis direction of the main shaft 10, so as to adjust the position of the sleeve 20 and the valve mechanism 50, and the cams 211, 212 with different projection heights are selectively enabled to contact the roller rocker arm 51 to change the valve lift, and the valve timing. The oil cylinder 30 directly drives the sleeve 20 to move, and a working position of the variable valve lift device is switched by a movement of the sleeve 20 without adding any other intermediate transition structure. Therefore, the variable valve lift device of an embodiment has the advantages of simple structure, compact arrangement space, simplicity in control, easiness in switching a working position, and the like.

Referring to FIG. 2, in an exemplary embodiment, the variable valve lift device further includes a return spring 40, the return spring 40 is sleeved on the main shaft 10, and the oil cylinder 30 and the return spring 40 are respectively located at both ends of the sleeve 20. When hydraulic oil is fed into the oil cylinder 30, the sleeve 20 is driven by the piston 32 to linearly move toward an end, away from the oil cylinder 30, of the main shaft 10, along the axis direction of the main shaft 10 and the sleeve 20 compresses the return spring 40. When hydraulic oil in the oil cylinder 30 flows out, the return spring 40 drives the sleeve 20 to linearly move toward an end where the oil cylinder 30 is located along the axis direction of the main shaft 10 through an elastic force.

Figure 6:
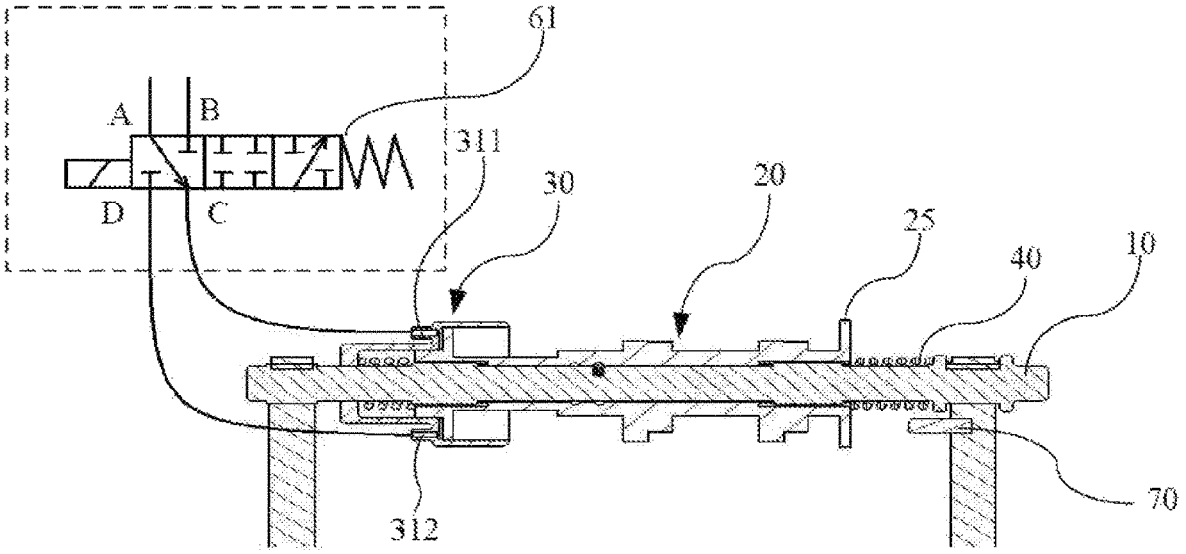
FIG. 6 is a schematic diagram showing connection between an oil cylinder and a reversing valve of a variable valve lift device in FIG. 2.

More specifically, FIG. 6 is a schematic diagram showing connection between an oil cylinder and a reversing valve in FIG. 2. As shown in FIG. 2 and FIG. 6, the oil barrel 31 is provided with an oil inlet 311 and an oil return port 312, an oil chamber 33 is disposed in the oil cylinder 30, and both the oil inlet 311 and the oil return port 312 are communicated with the oil chamber 33. In order to, control the oil cylinder 30, the variable valve lift device further includes a reversing valve 61, wherein the reversing valve 61 includes an oil port A and an oil port B on one side and an oil port C and an oil port D on the other side, the oil port C is connected to the oil inlet 311 of the oil cylinder 30, and the oil port D is connected to the oil return port 312 of the oil cylinder 30. The reversing valve 61 at least includes a middle position, a first working position and a second working position. When the reversing valve 61 is at the middle position, oil ports on both sides of the reversing valve 61 do not communicate with each other; when the reversing valve 61 is at the first working position, the oil port A communicates with the oil port C, the oil port B does not communicate with the oil port D, hydraulic oil flows from the oil inlet 311 to the oil cylinder 30 through the reversing valve 61, and the sleeve 20 is pushed by the piston 32 to move away from the oil cylinder 30 along the axis of the main shaft 10; and when the reversing valve 61 is at the second working position, the oil port B communicates with the oil port D, the oil port A does not communicate with the oil port C, hydraulic oil in the oil cylinder 30 flows out of the oil return port 312 through the reversing valve 61, and under a driving of the return spring 40, the sleeve 20 moves toward the oil cylinder 30 along the axis of the main shaft 10. By the switching of the working position of the reversing valve 61, the first cam 211 or the second cam 212 is selectively enabled to contact the valve mechanism 50, thereby achieving an aim of changing the valve lift.

It is to be understood that the number of cams in the cam assembly 21 is not limited to two, and more cams may be provided on the sleeve 20 to make the valve lift have more choices. In an embodiment having more cams with different projection heights, the position of the sleeve 20 can be changed by controlling the amount of flow of hydraulic oil into the oil cylinder 30 or the amount of flow from the oil cylinder 30 by controlling the reversing valve 61. Therefore, the cams with different projection heights are brought into contact with the valve mechanism 50.

In an exemplary embodiment, in order to more accurately control a stroke of the sleeve 20, the variable valve lift device further includes a position detection device for detecting a position of the sleeve 20.

In an exemplary embodiment, the position detection device may be a photoelectric position sensor 70, wherein the photoelectric position sensor 70 may be disposed at one end of the sleeve 20 and fixed to a support shaft such as the main shaft 10. In order to facilitate the detection of the position of the sleeve 20, a disc 25 extending perpendicularly to an axis direction of the sleeve 20 is also disposed on a side, face to the photoelectric position sensor 70, of the sleeve 20. It is to be understood that in other embodiments, the position detection device may also be other elements such as a contact switch.

In an exemplary embodiment, the oil cylinder 30 is further provided with a receiving cavity 34, a protruding portion 22 is provided at an end, close to the oil cylinder 30, of the sleeve 20, the protruding portion 22 protrudes into the receiving cavity 34, a buffer spring 35 is disposed in the receiving cavity 34, one end of the buffer spring 35 abuts against an end of the cylinder barrel 31, and the other end abuts against an end surface of the protruding portion 22. When the return spring 40 pushes the sleeve 20 to move to a left side of FIG. 2, the protruding portion 22 at the left end of the sleeve 20 gradually compresses the buffer spring 35, so that the sleeve 20 moves smoothly and prevents the piston 32 from colliding with the oil cylinder 30, thereby reducing the abnormal noise during a process of changing the valve lift.

Figure 7:
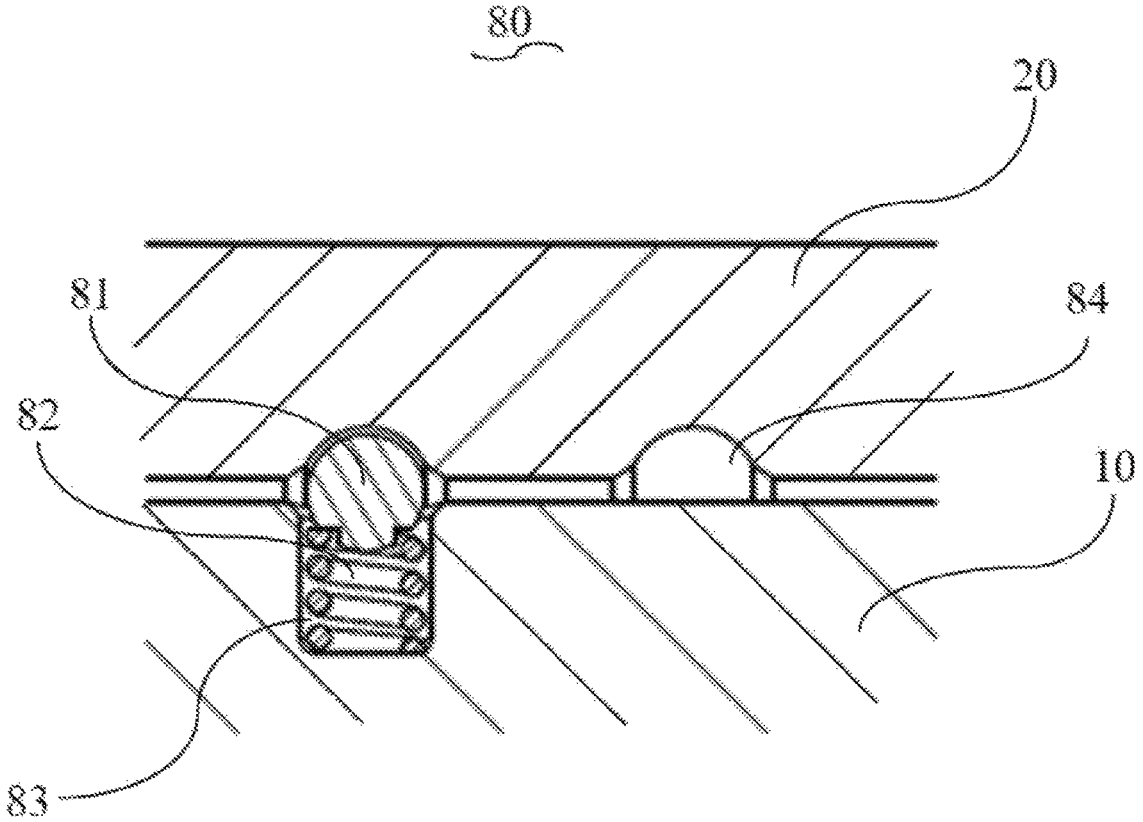
FIG. 7 is a cross-sectional enlarged schematic diagram of a locking mechanism of a variable valve lift device in FIG. 2.

FIG. 7 is a cross-sectional enlarged schematic diagram of a locking mechanism in FIG. 2. As shown in FIG. 2 and FIG. 7, in order to ensure the reliability of the first cam 211 or the second cam 212 in contact with the valve mechanism 50 during a movement of a vehicle and to prevent the first cam 211 or the second cam 212 from being out of contact with the valve mechanism 50, in an exemplary embodiment, the variable valve lift device includes a locking mechanism 80, wherein the locking mechanism 80 includes a locking ball head 81 and a locking spring 82, the locking ball head 81 is fixed to an end of the locking spring 82, one of the main shaft 10 and an inner side wall of the sleeve 20 is provided with a receiving groove 83, an end of the locking spring 82 away from the locking ball head 81 is fixed in the receiving groove 83, the other one of the main shaft 10 and the inner side wall of the sleeve 20 is provided with locking grooves 84, in an exemplary embodiment, the receiving groove 83 is provided on the main shaft 10, and the locking groove 84 is provided on the inner side wall of the sleeve 20. The number and spacing of the locking grooves 84 correspond to the number and spacing of the cams in the cam assembly 21. When any one of the cams is in contact with the valve mechanism 50, the locking ball head 81 extends into the locking groove 84 corresponding to the cam. In the present embodiment, since any one of the cams in the cam assembly 21 is in contact with the valve mechanism 50, the forces of the oil cylinder 30 and the return spring 40 are balanced with each other, and the locking mechanism 80 can prevent the sleeve 20 from shaking. When the variable valve lift device is adjusted, the forces of the oil cylinder 30 and the return spring 40 are no longer balanced, the sleeve 20 starts to move, the locking ball head 81 is disengaged from the locking groove 84, and the locking mechanism 80 no longer generates resistance to the sleeve 20.

Figure 8:
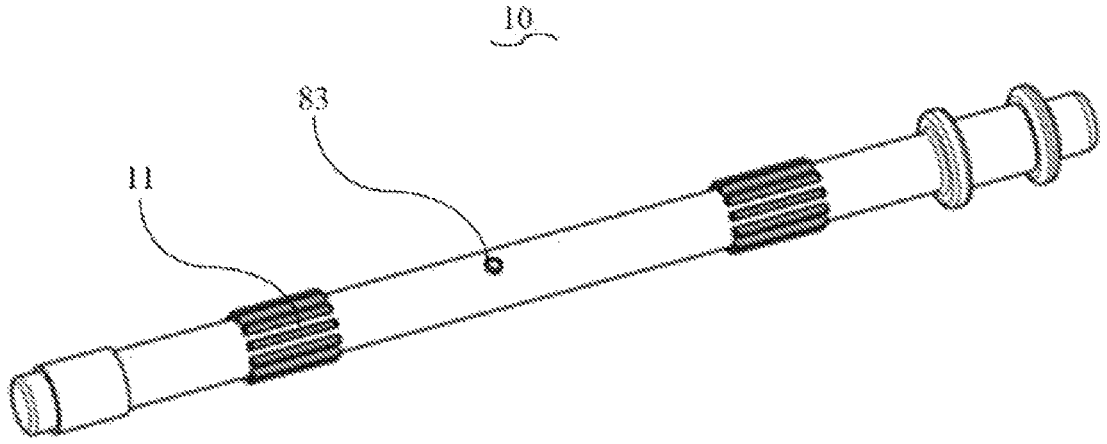
FIG. 8 is a structural schematic diagram of a main shaft of a variable valve lift device in FIG. 1.
Figure 9:
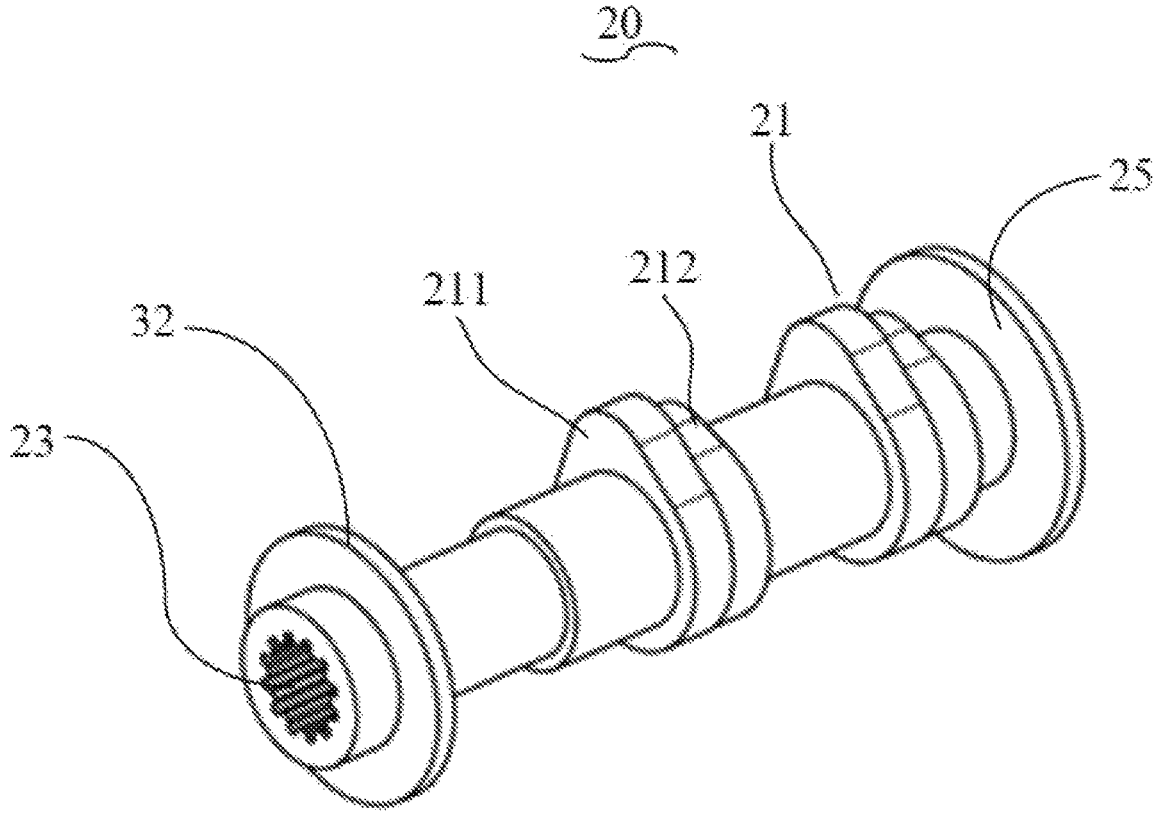
FIG. 9 is a structural schematic diagram of a sleeve of a variable valve lift device in FIG. 1.

FIG. 8 is a structural schematic diagram of a main shaft in FIG. 2. FIG. 9 is a structural schematic diagram of a sleeve in FIG. 2. As shown in FIG. 8 and FIG. 9, the main shaft 10 is provided with a spline 11 extending along the axis direction of the main shaft 10, and the inner side wall of the sleeve 20 is provided with a spline groove 23 complementary to the spline 11 of the main shaft 10. When the sleeve 20 is provided on the main shaft 10 in a sleeve manner, the spline 11 extends into the spline groove 23, so that the sleeve 20 can move along the axis direction of the main shaft 10 and can also rotate together with the main shaft 10.

Figure 10:
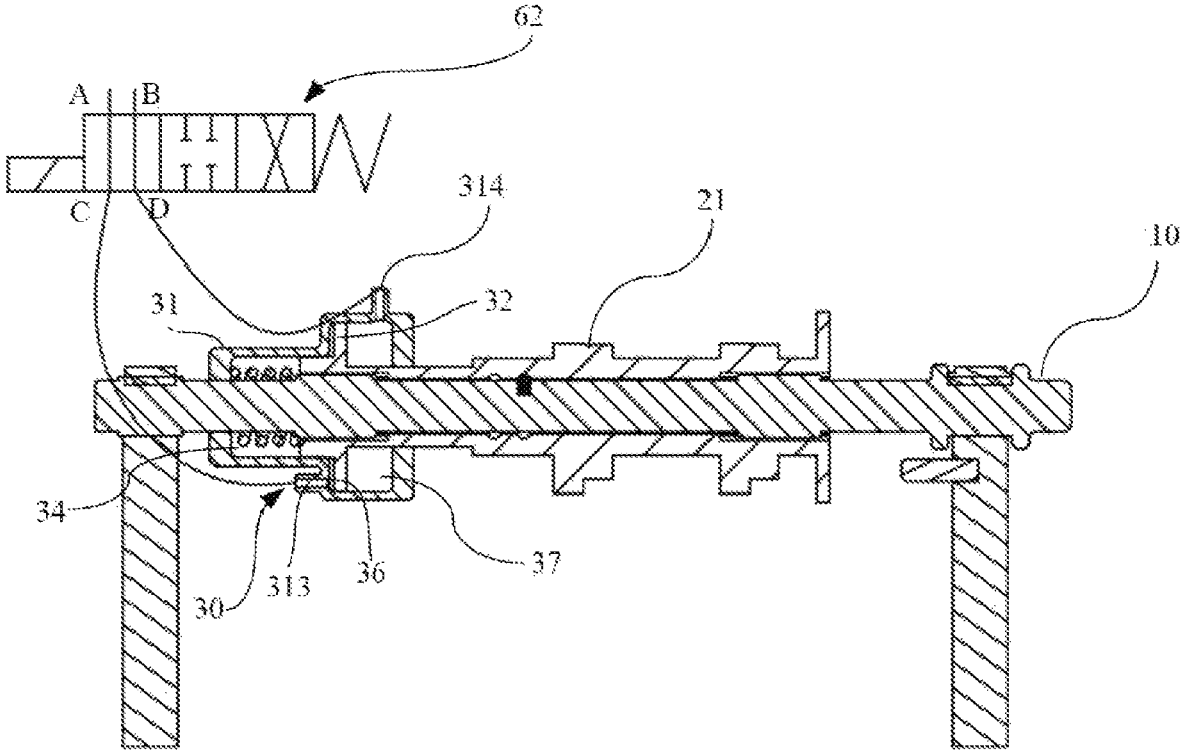
FIG. 10 is a structural schematic diagram of, a variable valve lift device according to a second embodiment of the present disclosure.

FIG. 10 is a structural schematic diagram of a variable valve lift device according to a second embodiment of the present disclosure. As shown in FIG. 10, in the second embodiment, the structure of the variable valve lift device is basically the same as the structure in the first embodiment, except that a first oil chamber 36 is formed between one end of the cylinder barrel 31 and the piston 32, and a second oil chamber 37 is formed between the other end of the cylinder barrel 31 and the piston 32. When hydraulic oil is fed into the first oil chamber 36 and hydraulic oil in the second oil chamber 37 flows out, the oil cylinder 30 drives, through the piston 32, the sleeve 20 to linearly move toward one end of the main shaft 10 along the axis direction of the main shaft 10; and when hydraulic oil is fed into the second, oil chamber 37 and hydraulic oil in the first oil chamber 36 flows out, the oil cylinder 30 drives, through the piston 32, the sleeve 20 to linearly move toward the other end of the main shaft 10 along the axis direction of the main shaft 10.

In order to control the oil cylinder 30, in the second embodiment, the oil cylinder 30 includes a first oil port 313 and a second oil port 314, the first oil port 313 communicates with the first oil chamber 36, and the second oil port 314 communicates with the second oil chamber 37. The variable valve lift device includes a reversing valve 62, wherein the reversing valve 62 includes an oil port A and an oil port B on one side and an oil port C and an oil port D on the other side, the oil port C is connected to the first oil port 313 of the oil cylinder 30, and the oil port D is connected to the second oil port 314 of the oil cylinder 30. The reversing valve 62 at least includes a middle position, a first working position and a second working position. When the reversing valve 62 is at the middle position, oil ports on both sides of the reversing valve 62 do not communicate with each other; when the reversing valve 62 is at the first working position, the oil port A communicates with the oil port C, the oil port B communicates with the oil port D, and the sleeve 20 is pushed by the piston 32 to linearly move to one side away from the oil cylinder 30 along the axis direction of the main shaft 10; and when the reversing valve 62 is at the second working position, the oil port A communicates with the oil port D, the oil port B communicates with the oil port C, and the piston 32 drives the sleeve 20 to linearly move to one side where the oil cylinder 30 is located along the axis direction of the main shaft 10. By the switching of the working position of the reversing valve 62, the cams with different projection heights can be brought into contact with the valve mechanism 50 as needed.

In conclusion, in some embodiments of the present disclosure, the sleeve 20 can move along the axis direction of the main shaft 10, and can also rotate together with the main shaft 10 under the driving of the main shaft 10. By means of the oil cylinder 30, the position of the sleeve 20 and the valve mechanism 50 can be adjusted under the driving of the oil cylinder 30, and the cams 211, 212 with different projection heights are selectively enabled to contact the roller rocker arm 51, so as to change the valve lift and the valve timing. The oil cylinder 30 controls the sleeve 20 to linearly move on the main shaft 10, and the working position of the variable valve lift device is switched without adding any other intermediate transition structure. Therefore, the variable valve lift device has the advantages of simple structure, compact arrangement space, simplicity in control, easiness in switching a working position, and the like.

The embodiment of the present disclosure also provides an automobile, including the above variable valve lift device.

The above implementations are merely embodiments of the present disclosure, and are not intended to limit the scope of implementations and claims of the present disclosure, and any equivalent changes and modifications made in the scope of protection of the present disclosure should fall within the scope of patent protection of the present disclosure.

INDUSTRIAL APPLICABILITY

In the embodiment of the present disclosure, the sleeve can move along the axis direction of the main shaft, and can also rotate together with the main shaft under the driving of the main shaft. By means of the oil cylinder, the position of the sleeve and the valve mechanism can be adjusted under the driving of the oil cylinder, and the cams with different projection heights are selectively enabled to contact a roller rocker arm to change the valve lift and the valve timing. The oil cylinder controls the sleeve to linearly move on the main shaft, and the working position of the variable valve lift device is switched without adding any other intermediate transition structure. Therefore, the variable valve lift device has the advantages of simple structure, compact arrangement space, simplicity in control, easiness in switching a working position, and the like.

What is claimed is:

1. A variable valve lift device, comprising a main shaft, a sleeve, an oil cylinder and a valve mechanism, wherein the sleeve is provided on the main shaft in a sleeve manner, the sleeve can be driven by the main shaft to rotate together with the main shaft, and the sleeve can further linearly move relative to the main shaft along an axis direction of the main shaft; a cam assembly is provided on the sleeve, and the cam assembly comprises at least two cams with different projection heights; and the oil cylinder comprises a cylinder barrel and a piston provided in the cylinder barrel, the cylinder barrel is fixed onto the main shaft, the piston is fixedly connected to the sleeve, and the oil cylinder is configured to drive the sleeve to linearly move relative to the main shaft along the axis direction of the main shaft, and selectively enabling the at least two cams with different projection heights to contact the valve mechanism;

wherein the variable valve lift device further comprises a return spring, wherein the return spring is sleeved on the main shaft, the oil cylinder and the return spring are respectively located at both ends of the sleeve, when hydraulic oil is fed into the oil cylinder, the sleeve is driven by the piston to linearly move toward one end of the main shaft along the axis direction of the main shaft and compresses the return spring, and when hydraulic oil in the oil cylinder flows out, the return spring drives the sleeve to linearly move toward the other end of the main shaft along the axis direction of the main shaft through an elastic force;

wherein the oil cylinder is further provided with a receiving cavity, a protruding portion is provided at an end, close to the oil cylinder, of the sleeve, the protruding portion protrudes into the receiving cavity, a buffer spring is disposed in the receiving cavity, one end of the buffer spring abuts against an end of the cylinder barrel, and another end of the buffer spring abuts against an end surface of the protruding portion.

2. The variable valve lift device as claimed in claim 1, wherein the at least two cams with different projection heights comprise a first cam and a second cam, the first cam and the second cam are provided adjacent to each other, and a projection height of the first cam is greater than a projection height of the second cam.

3. The variable valve lift device as claimed in claim 1, wherein the oil cylinder comprises an oil inlet and an oil return port, the oil cylinder has an oil chamber, and both the oil inlet and the oil return port are communicated with the oil chamber; the variable valve lift device further comprises a reversing valve; the reversing valve comprises an oil port A and an oil port B on one side and an oil port C and an oil port D on the another side, the oil port C is connected to the oil inlet of the oil cylinder, and the oil port D is connected to the oil return port of the oil cylinder; the reversing valve comprises a middle position, a first working position and a second working position; when the reversing valve is at the middle position, each of the oil port A and the oil port B on the side of the reversing valve does not communicate with the oil port C and the oil port D on the other side respectively; when the reversing valve is at the first working position, the oil port A communicates with the oil port C, and the oil port B does not communicate with the oil port D; and when the reversing valve is at the second working position, the oil port B communicates with the oil port D, and the oil port A does not communicate with the oil port C.

4. The variable valve lift device as claimed in claim 1, wherein a first oil chamber is formed between one end of the cylinder barrel and the piston, and a second oil chamber is formed between another end of the cylinder barrel and the piston; when hydraulic oil is fed into the first oil chamber and hydraulic oil in the second oil chamber flows out, the oil cylinder drives, through the piston, the sleeve to linearly move toward one end of the main shaft along the axis direction of the main shaft; and when hydraulic oil is fed into the second oil chamber and hydraulic oil in the first oil chamber flows out, the oil cylinder drives, through the piston, the sleeve to linearly move toward another end of the main shaft along the axis direction of the main shaft.

5. The variable valve lift device as claimed in claim 4, wherein the oil cylinder comprises a first oil port and a second oil port, wherein the first oil port communicates with the first oil chamber, and the second oil port communicates with the second oil chamber; the variable valve lift device further comprises a reversing valve; the reversing valve comprises an oil port A and an oil port B on one side and an oil port C and an oil port D on another side, the oil port C is connected to the first oil port of the oil cylinder, and the oil port D is connected to the second oil port of the oil cylinder; the reversing valve comprises a middle position, a first working position and a second working position; when the reversing valve is at the middle position, oil ports on both sides of the reversing valve do not communicate with each other; when the reversing valve is at the first working position, the oil port A communicates with the oil port C, and the oil port B communicates with the oil port D; and when the reversing valve is at the second working position, the oil port A communicates with the oil port D, and the oil port B communicates with the oil port C.

6. The variable valve lift device as claimed in claim 1, further comprising a position detection device, wherein the position detection device is configured to detect a position of the sleeve.

7. The variable valve lift device as claimed in claim 1, further comprising a locking mechanism, wherein the locking mechanism comprises a locking ball head and a locking spring, the locking ball head is fixed to an end of the locking spring, one of an inner side wall of the sleeve and the main shaft is provided with a receiving groove, the locking spring is fixed in the receiving groove, the other one of the inner side wall of the sleeve and the main shaft is provided with locking grooves, a number and spacing of the locking grooves correspond to a number and spacing of the at least two cams in the cam assembly, and when any one of the at least two cams in the cam assembly is in contact with the valve mechanism, the locking ball head extends into a locking groove in the locking grooves corresponding to a cam in the at least two cams.

8. The variable valve lift device as claimed in claim 7, wherein the receiving groove is provided on the main shaft, and the locking groove is provided on the inner side wall of the sleeve.

9. The variable valve lift device as claimed in claim 1, wherein the main shaft is provided with a spline extending along the axis direction of the main shaft, an inner side wall of the sleeve is provided with a spline groove fitting the spline, and when the sleeve is provided on the main shaft in a sleeve manner, the spline extends into the spline groove.

10. An automobile, comprising the variable valve lift device as claimed in claim 1.

* * * * *